US009217546B2

(12) United States Patent
Hu

(10) Patent No.: US 9,217,546 B2
(45) Date of Patent: Dec. 22, 2015

(54) LED BULB LATERALLY INSTALLED AND PROJECTING LIGHT BEAMS ONTO GROUND

(71) Applicant: Wen-Sung Hu, Tainan (TW)

(72) Inventor: Wen-Sung Hu, Tainan (TW)

( * ) Notice: Subject to any disclaimer, the term of this patent is extended or adjusted under 35 U.S.C. 154(b) by 402 days.

(21) Appl. No.: 13/739,116

(22) Filed: Jan. 11, 2013

(65) Prior Publication Data

US 2014/0198495 A1 Jul. 17, 2014

(51) Int. Cl.

| | |
|---|---|
| ***F21V 1/00*** | (2006.01) |
| ***F21K 99/00*** | (2010.01) |
| *F21Y 101/02* | (2006.01) |
| *F21V 23/00* | (2015.01) |
| *F21Y 111/00* | (2006.01) |
| *F21V 29/76* | (2015.01) |

(52) U.S. Cl.
CPC ... *F21K 9/58* (2013.01); *F21K 9/13* (2013.01); *F21V 23/002* (2013.01); *F21V 29/763* (2015.01); *F21Y 2101/02* (2013.01); *F21Y 2111/001* (2013.01)

(58) Field of Classification Search
CPC ..... F21V 19/02; F21V 1/00; F21V 23/002; F21V 29/763; F21K 9/00; F21K 9/13; F21K 9/58; F21Y 2101/02
USPC ..... 362/430, 235, 249.03, 249.02, 650
See application file for complete search history.

(56) References Cited

U.S. PATENT DOCUMENTS

| | | | | |
|---|---|---|---|---|
| 2010/0238672 | A1* | 9/2010 | Wu et al. | 362/373 |
| 2011/0089838 | A1* | 4/2011 | Pickard et al. | 315/113 |

* cited by examiner

*Primary Examiner* — Anh Mai
*Assistant Examiner* — Jessica M Apenteng
(74) *Attorney, Agent, or Firm* — Alan D. Kamrath; Kamrath IP Lawfirm, P.A.

(57) ABSTRACT

An LED bulb laterally installed and projecting light beams onto the ground includes a bulb holder assembly, a lamp carrier assembly, a luminosity module, a lampshade, a collar, and a clasper. The bulb holder assembly includes a bulb holder base and a bulb holder. The lamp carrier assembly includes a tubular column and a shell body formed on an end of the tubular column. The luminosity module is installed in the shell body and includes at least an LED. The collar is securely connected to the bulb holder base and mounted around the tubular column for development of an accommodating space between the collar and the tubular column. The clasper is closely engaged in the accommodating space and securely connected to the tubular column. The lamp carrier assembly is omni-directionally adjusted relative to the bulb holder base to make the LEDs' projecting plane face the ground surface.

8 Claims, 16 Drawing Sheets

LED BULB LATERALLY INSTALLED AND PROJECTING LIGHT BEAMS ONTO GROUND

BACKGROUND OF THE INVENTION

The present invention relates to a LED bulb and, more particularly, to a LED bulb laterally installed and projecting light beams onto the ground.

As the green energy policy is highly promoted in international society, many advanced countries have thus set up the utilization deadline for tungsten bulbs. Light-emitting diode (LED) bulbs thus gradually enter the replacement market of tungsten bulbs.

As shown in FIGS. 1 through 3, conventional tungsten light bulbs 2 projecting light beams around 360 degrees are laterally (horizontally) installed in a bulb socket 3, radiating projected beams 4 which include light beams projected on the ground surface, and creating an illumination effect in a vertical direction. A bulb manufactured with a luminosity module based on LEDs (SMD/chips), however, features unidirectional projected light but fails to vertically project light beams onto the ground surface when the LED bulb projecting unidirectional light is laterally (horizontally) installed in a bulb socket. Accordingly, general lamps with upward bulb holders have been replaced by compact fluorescent lamps (CFL), such as HCFL and CCFL, when tungsten light bulbs were out of time.

Compact fluorescent lamps, however, still have some drawbacks as follows: (1) Intermittent light from a luminous source activated by variable voltages is unhealthy for eyes during reading. (2) Mercury gas in a compact fluorescent lamp threatens the human body if the lamp is broken, and some costs are indispensable to disposal of compact fluorescent lamps. (3) Ultraviolet projected from a compact fluorescent lamp is harmful to skin in a short distance.

Accordingly, it has become a critical issue for LED manufacturers to design an LED bulb laterally installed and projecting light beams onto the ground as an environment-friendly and energy-efficient product.

BRIEF SUMMARY OF THE INVENTION

Therefore, it is an objective of the present invention to overcome the aforementioned shortcoming and deficiency of the prior art by providing a LED bulb laterally installed and projecting light beams onto the ground. When the LED bulb is assembled into a laterally (horizontally) arranged bulb socket, a lamp carrier assembly of the LED bulb can be adjusted to any angle and project light beams on the ground surface.

To achieve this and other objectives, a LED bulb of the present invention includes a bulb holder assembly, a lamp carrier assembly, a luminosity module, a lampshade, a collar, and a clasper. The bulb holder assembly includes a bulb holder base and a bulb holder installed on a lower end of the bulb holder base. A top opening is formed in an upper end of the bulb holder base, with an actuator provided in the bulb holder base. The lamp carrier assembly includes a tubular column having a first end mounted in the top opening of the bulb holder base. A shell body is formed at a second end of the tubular column and has at least one opening for projection of light beams. A 90-degree or 45-degree projecting angle is formed between a direction of the projected light beams from the opening of the shell body and an axial direction of the tubular column. A luminosity module is installed inside the shell body and electrically connected to the actuator. The luminosity module includes at least one substrate and at least one LED on the at least one substrate. The lampshade is assembled on the opening of the shell body for transmission of light beams out of the LED. The collar is mounted around the first end of the tubular column and secured to the upper end of the bulb holder base. The collar includes an annular joining portion formed at a lower end thereof, and an accommodating space is formed between the joining portion and the tubular column. The clasper is closely engaged in the accommodating space and securely connected to the first end of the tubular column. The lamp carrier assembly can be adjusted relative to the bulb holder base for projecting light beams out of the LED on the ground surface.

In a preferred form, the collar joins the bulb holder base with threads, screws, rivets, pins or by fusion connection, and the clasper joins the tubular column with threads, screws, rivets, pins or by fusion connection.

In a preferred form, a plurality of knurls is formed on each of an outer surface of the bulb holder base, an outer periphery of the shell body, and an outer surface of the collar and extends in the axial direction of the tubular column.

In a preferred form, the shell body includes two opposed openings, with a 90-degree projecting angle formed between a direction of the light beams projected from each opening of the shell body and the axial direction of the tubular column. The luminosity module includes upper and lower substrates and LEDs on an outer surface of each of the upper and lower substrates, and the upper and lower substrates are installed on both flanks of a heat sink body.

In a preferred form, the shell body is an opaque semicircular body or a transparent tubular body.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
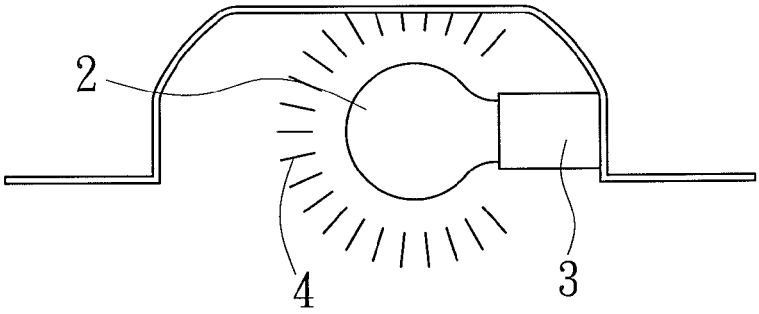
FIG. 1 Prior Art
FIG. 1 is a schematic view of a conventional tungsten bulb.
Figure 2:
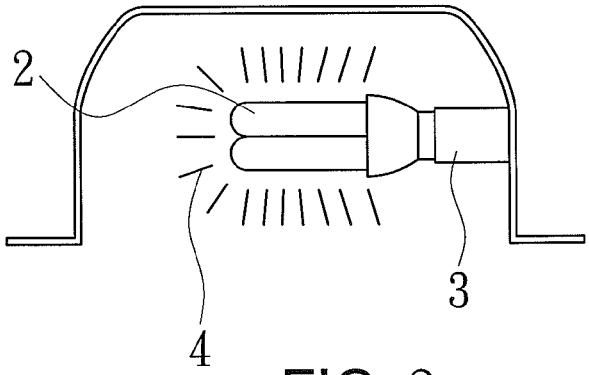
FIG. 2 Prior Art
FIG. 2 is a schematic view of another conventional tungsten bulb.
Figure 3:
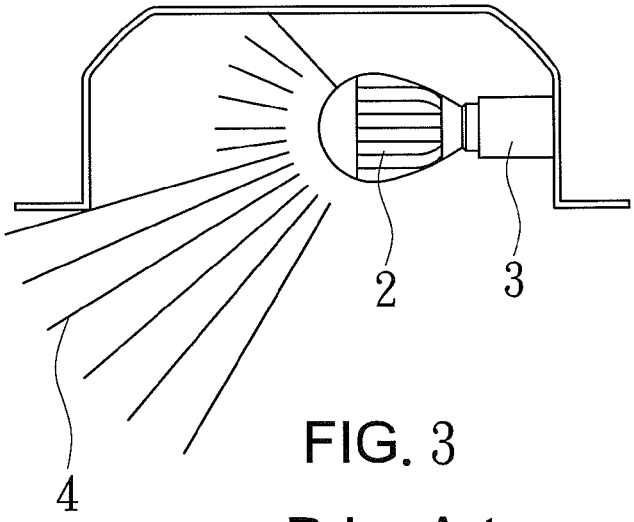
FIG. 3 Prior Art
FIG. 3 is a schematic view of a further conventional tungsten bulb.
Figure 4:
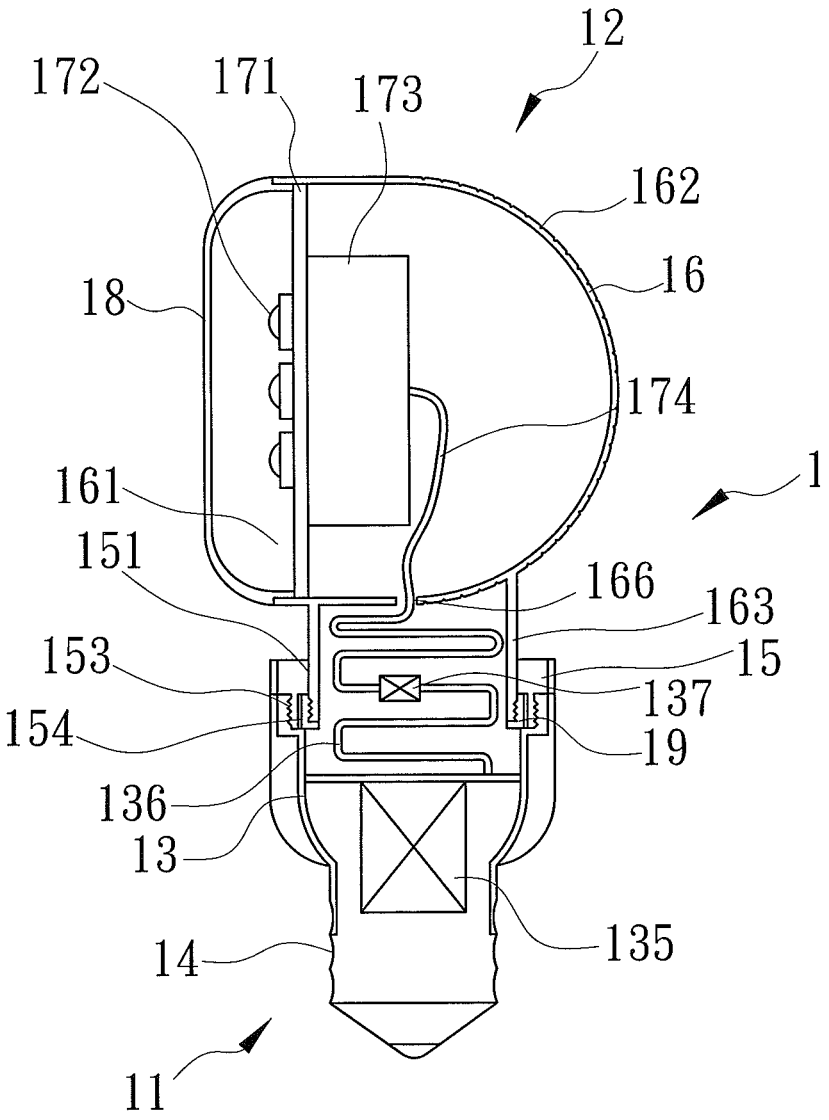
FIG. 4 is a schematic view of a LED bulb according to a first embodiment of the present invention.
Figure 5:
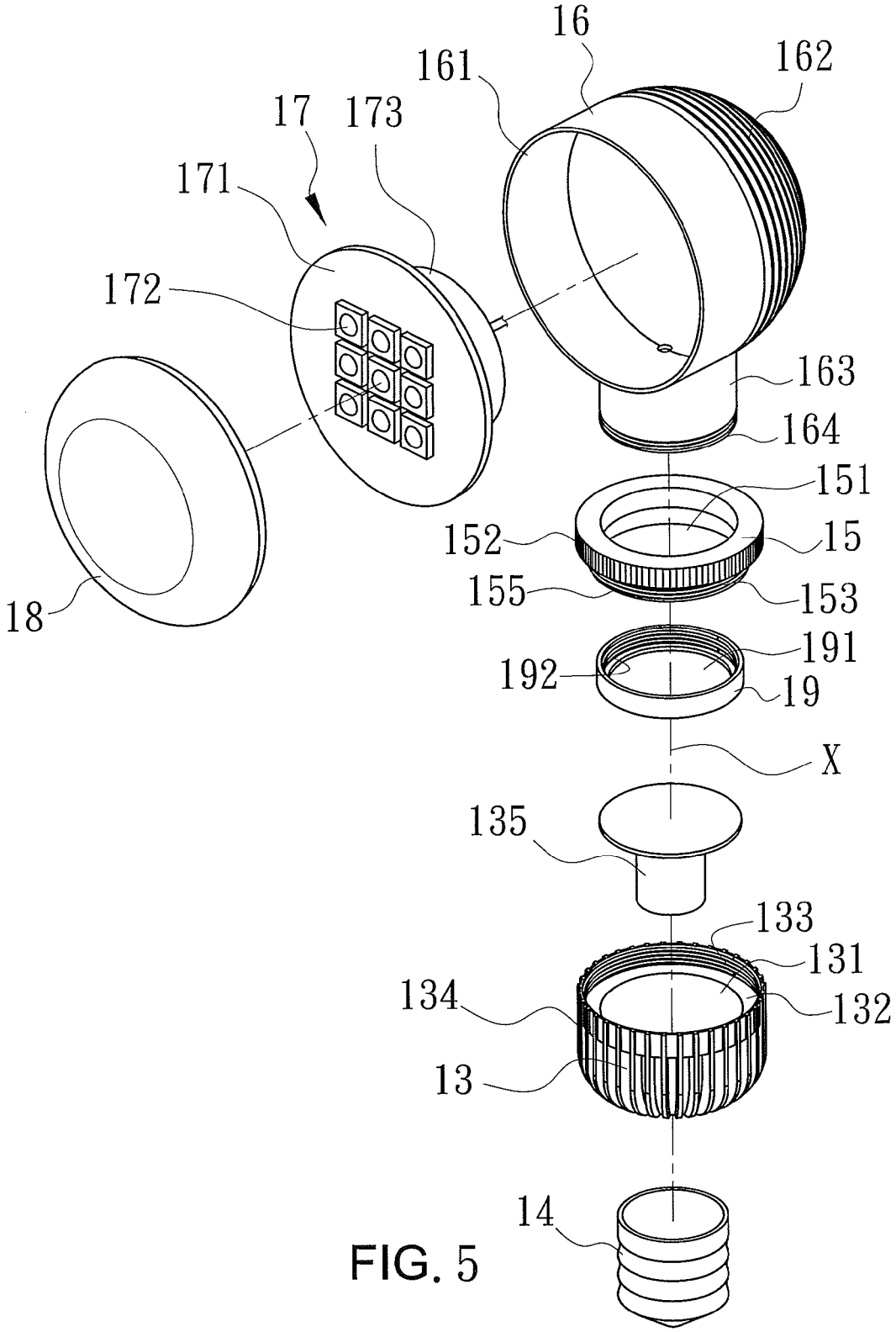
FIG. 5 is an exploded, perspective view of the LED bulb of FIG. 4.

A LED bulb of a first embodiment of the present invention is shown in FIGS. 4 and 5 of the drawings and generally designated 1. In the embodiment, the LED bulb 1 includes a bulb holder assembly 11 and a lamp carrier assembly 12. The bulb holder assembly 11 includes a bulb holder base 13 and a bulb holder 14 installed on a lower end of the bulb holder base 13. A top opening 131 is formed in an upper end of the bulb holder base 13, and an annular ledge 132 is provided on an upper inner surface of the bulb holder base 13. Female threads 133 are provided on the upper inner surface of the bulb holder base 13 and between the annular ledge 132 and the top opening 131. A plurality of knurls 134 is formed on an outer surface of the bulb holder base 13 and extends in an axial direction (X) of the bulb holder 14. Further, the bulb holder base 13 is provided with an actuator 135 therein. The actuator 135 links a wiring component 136 to which an adapter 137 is connected.

The lamp carrier assembly 12 includes a generally semicircular shell body 16 and a tubular column 163. The tubular column 163 is a round tube having a first end 164 with male threads. The first end 164 of the tubular column 163 is mounted in the top opening 131 of the bulb holder base 13. The shell body 16 is situated at a second end (the other end) of the tubular column 163 and has an opening 161 for projection of light beams. In the embodiment, the light beams from the opening 161 are projected along a direction perpendicular to an axial direction (X) of the tubular column 163 (the same as the axial direction (X) of the bulb holder 14). The shell body 16 can be manufactured with metal material and provided with a plurality of straight knurls 162 whose patterns are parallel to knurls 134 on the bulb holder base 13.

The LED bulb 1 further includes a luminosity module 17, a lampshade 18, a collar 15 and a clasper 19. The luminosity module 17 is installed in the shell body 16 and includes a substrate 171 and one or a number of LEDs (SMD/chips) 172 on an outer surface of the substrate 171. The substrate 171 is equipped with a heat sink body 173 at an inner surface thereof for expelling heat out of the luminosity module 17. The luminosity module 17 links a circuit component 174, which is electrically connected to the wiring component 136 of the bulb holder assembly 11 via a circuit hole 166 in the shell body 16, in order to project light beams toward the opening 161 of the shell body 16 when the LEDs 172 is actuated by the actuator 135. The lampshade 18 is transparent and assembled on the opening 161 of the shell body 16, allowing light beams out of the LEDs 172 to be transmitted through the lampshade 18.

The collar 15 centrally develops an orifice 151 penetrated by the first end 164 of the tubular column 163 and is mounted around the first end 164 of the tubular column 163. The collar 15 is externally provided with knurls 152 extending axially. The collar 15 includes an annular joining portion 153 formed at a lower end thereof and having an inner diameter greater than that of the orifice 151 for development of an accommodating space 154 between the joining portion 153 and the tubular column 163 when the collar 15 is mounted around the first end 164 of the tubular column 163. In the embodiment, an outer surface of the joining portion 153 is formed with male threads 155 which are used to couple with the female threads 133 on the upper inner surface of the bulb holder base 13, so that the collar 15 can be secured to the upper end of the bulb holder base 13. The clasper 19 is an annular body with an annular orifice 191 centrally and has an outer diameter almost equal to an inner diameter of the joining portion 153, so that the clasper 19 can be closely embedded into the accommodating space 154 between the joining portion 153 and the tubular column 163. The annular orifice 191 of the clasper 19 is provided with female threads 192 which engage with male threads on the first end 164 of the tubular column 163.

Figure 6:
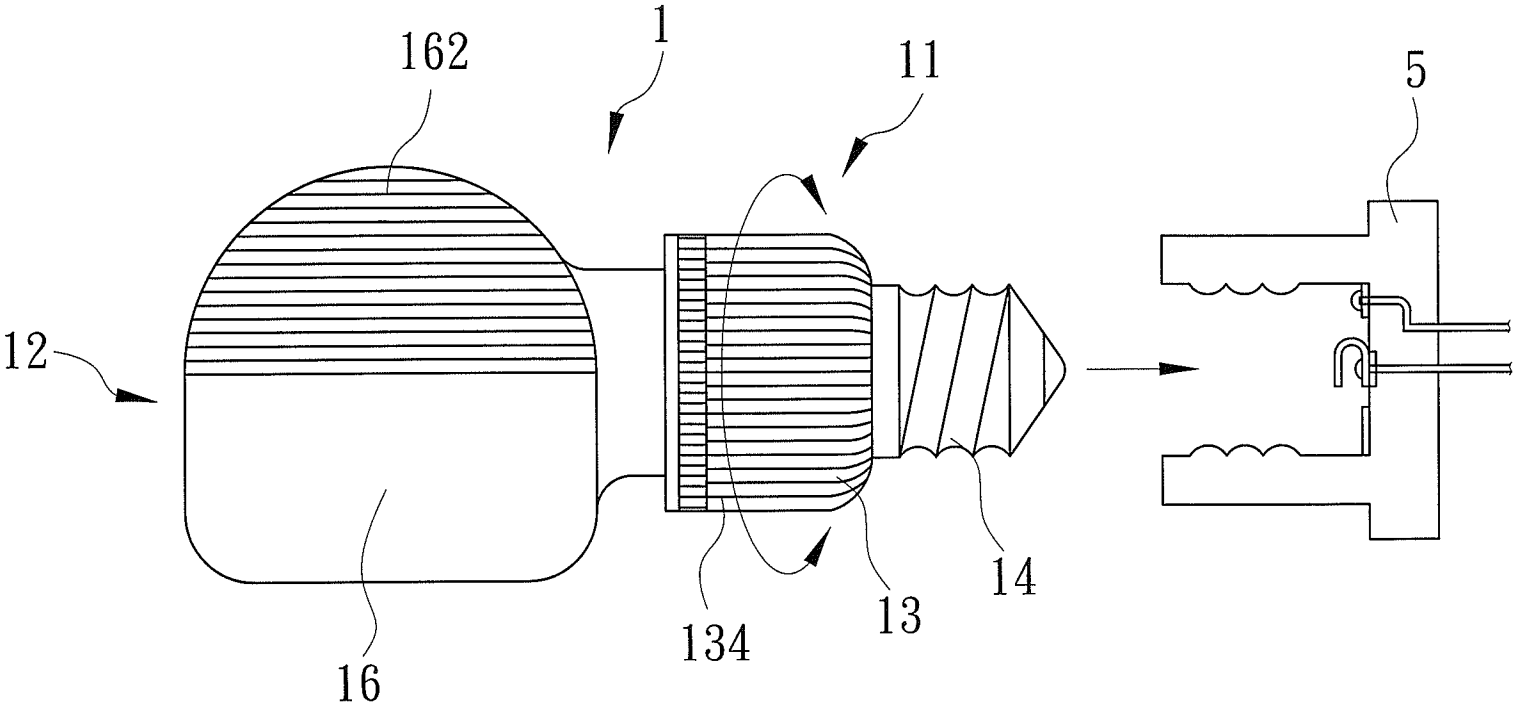
FIG. 6 is a schematic view illustrating the LED bulb of FIG. 4 to be assembled into a horizontally arranged bulb socket.
Figure 7:
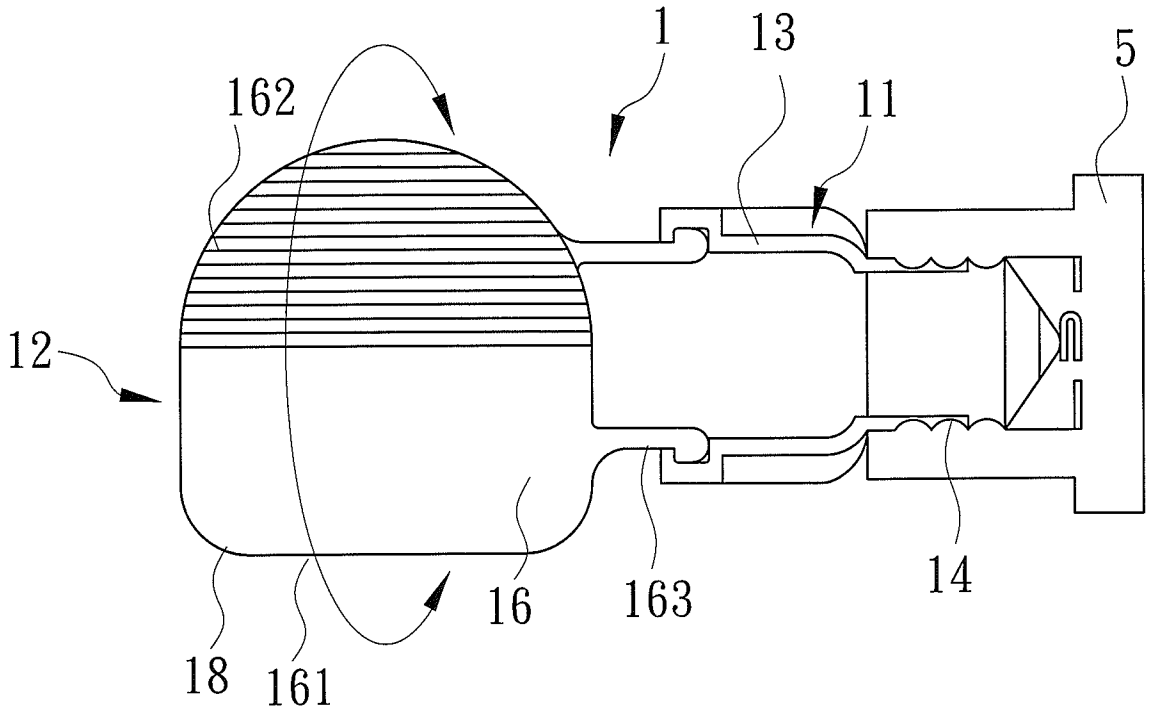
FIG. 7 is a schematic view illustrating the LED bulb of FIG. 6 assembled into the horizontally arranged bulb socket.
Figure 8:
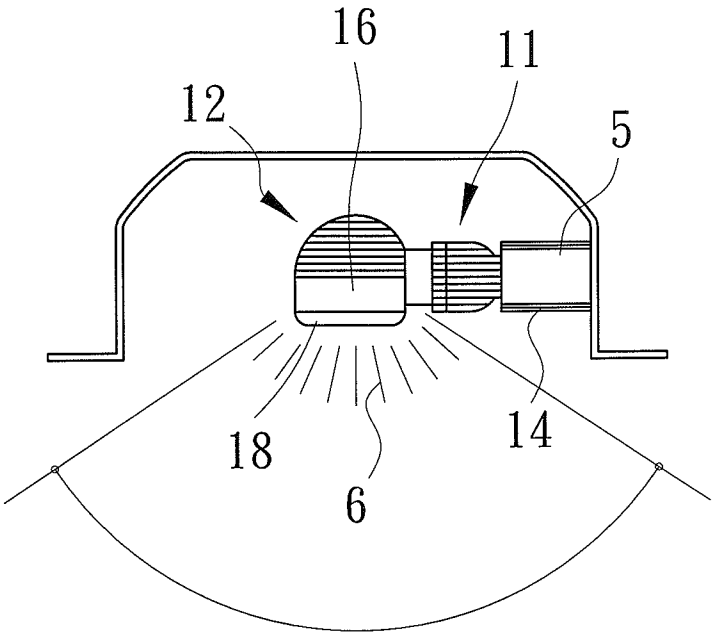
FIG. 8 is a schematic view illustrating light beams projected to the ground surface from the LED bulb in FIG. 7.

FIG. 6 is a schematic view illustrating the LED bulb 1 of the present invention to be installed in a horizontally arranged bulb socket 5. The bulb holder 14 of the LED bulb 1 can be screwed into the bulb socket 5 by fingers grasping the knurls 134 on the bulb holder base 13 (knurls 134, 162, 152 are designed for secure grasping). FIG. 7 is a schematic view illustrating the LED bulb 1 which has been assembled into the bulb socket 5. Light beams transmitted and projected through the lampshade 18 are perpendicular to the bulb holder 14 which has been totally screwed into the bulb socket 5, because the opening 161 is adjusted to face the ground surface with fingers grasping the knurls 162 on the shell body 16 and turning the shell body 16. FIG. 8 illustrates the LED bulb 1 is assembled into the laterally arranged bulb socket 5 for projecting light beams 6 onto the ground surface and making illumination toward the ground available.

Figure 9:
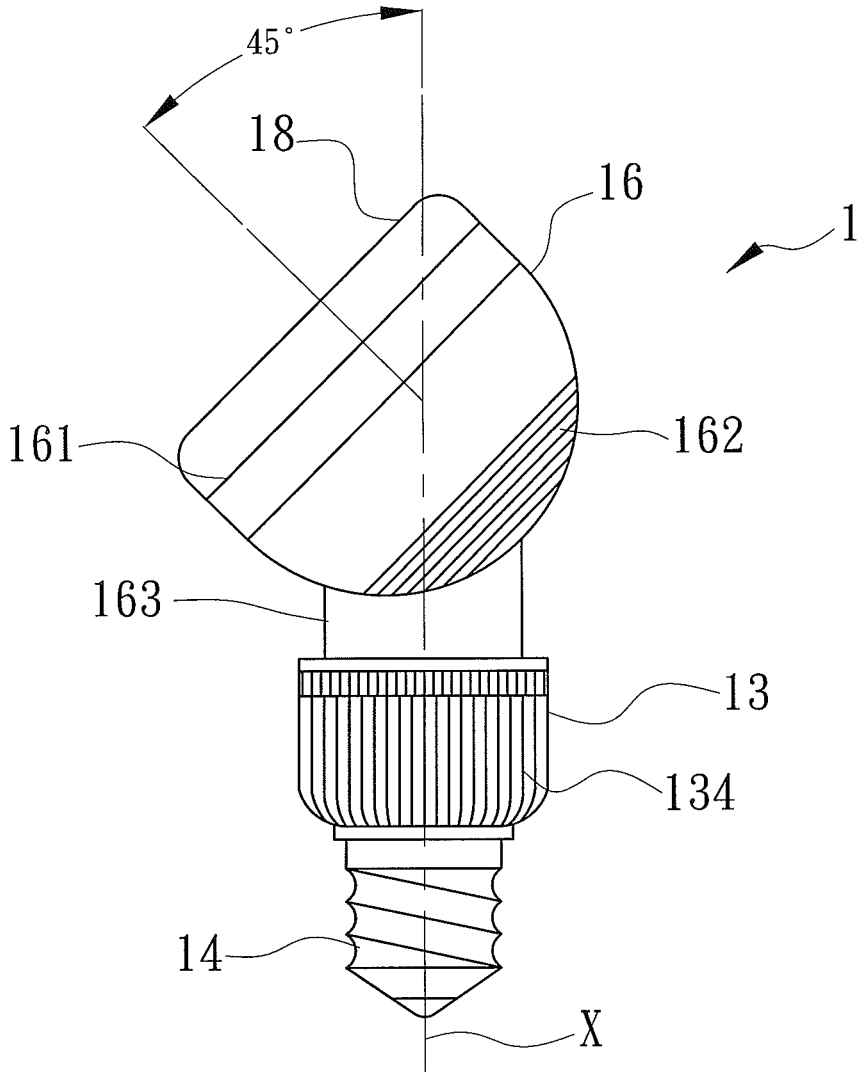
FIG. 9 is a schematic view of a LED bulb according to a second embodiment of the present invention.
Figure 10:
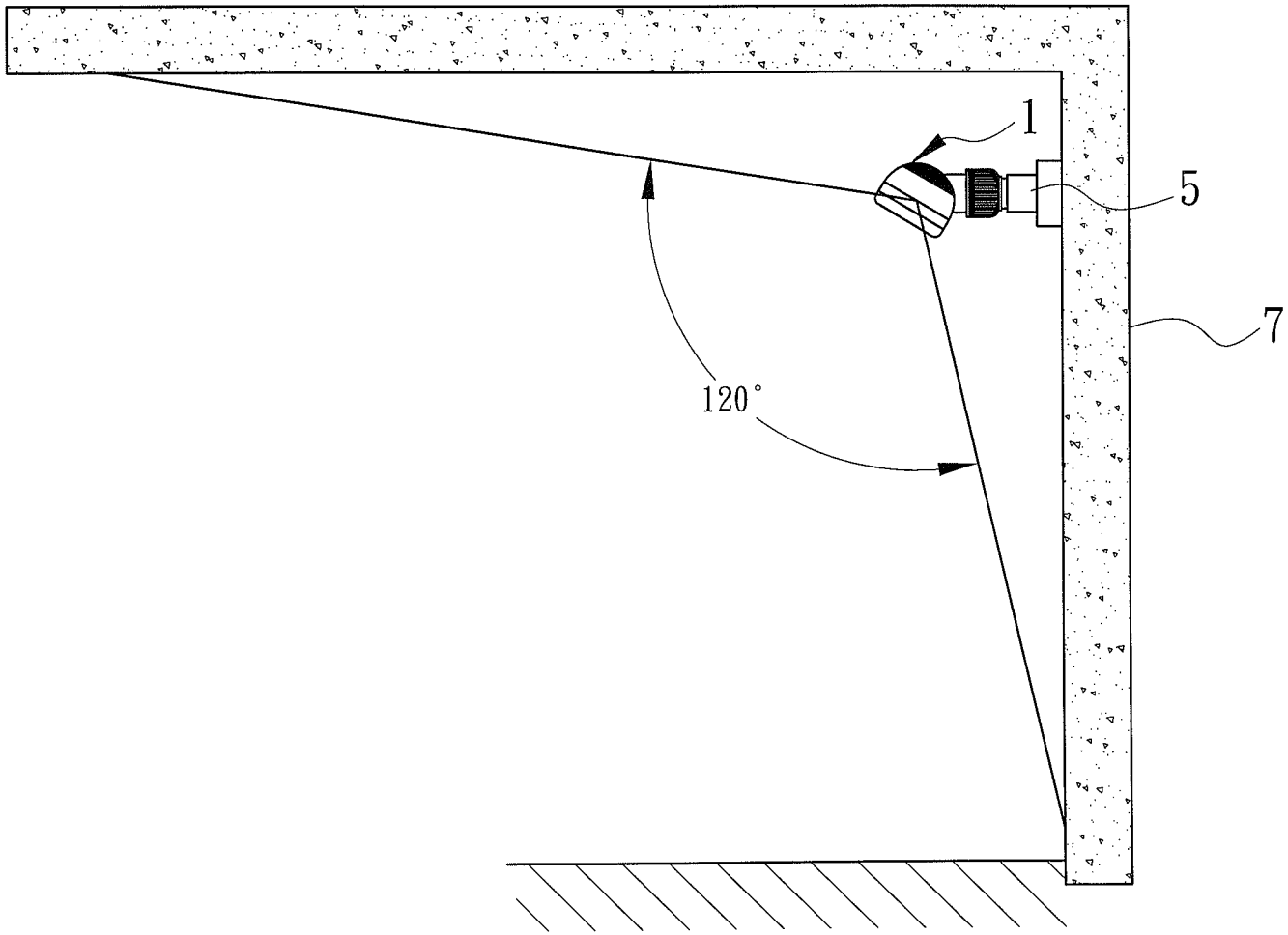
FIG. 10 is a schematic view illustrating the LED bulb of FIG. 9 which has been assembled into the horizontally arranged bulb socket.

FIG. 9 illustrates a LED bulb 1 of a second embodiment of the present invention. In the embodiment, a 45-degree projecting angle between a direction of the light beams projected from the opening 161 and the axial direction (X) of the tubular column 163 results in a maximized illumination area (for example, light beams projected within about 120 degrees in FIG. 10) when the LED bulb 1 is installed in the laterally arranged bulb socket 5 which is fixed on a wall 7.

Figure 11:
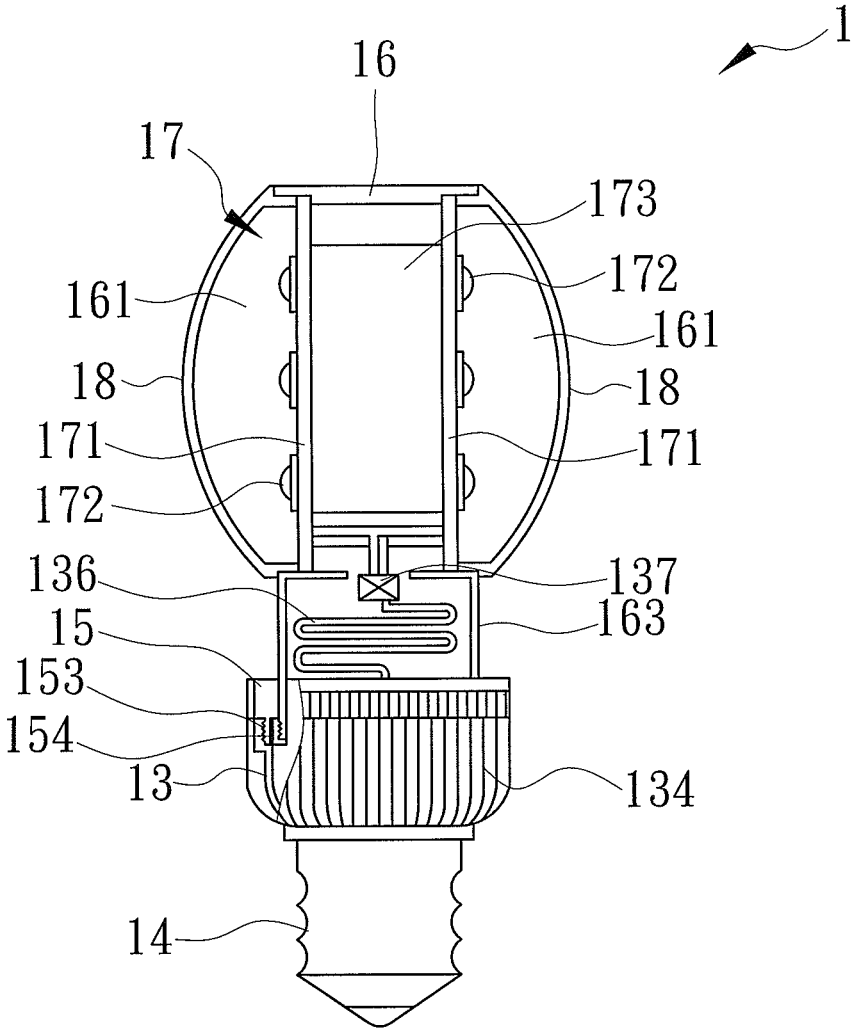
FIG. 11 is a schematic view of a LED bulb according to a third embodiment of the present invention.
Figure 12:
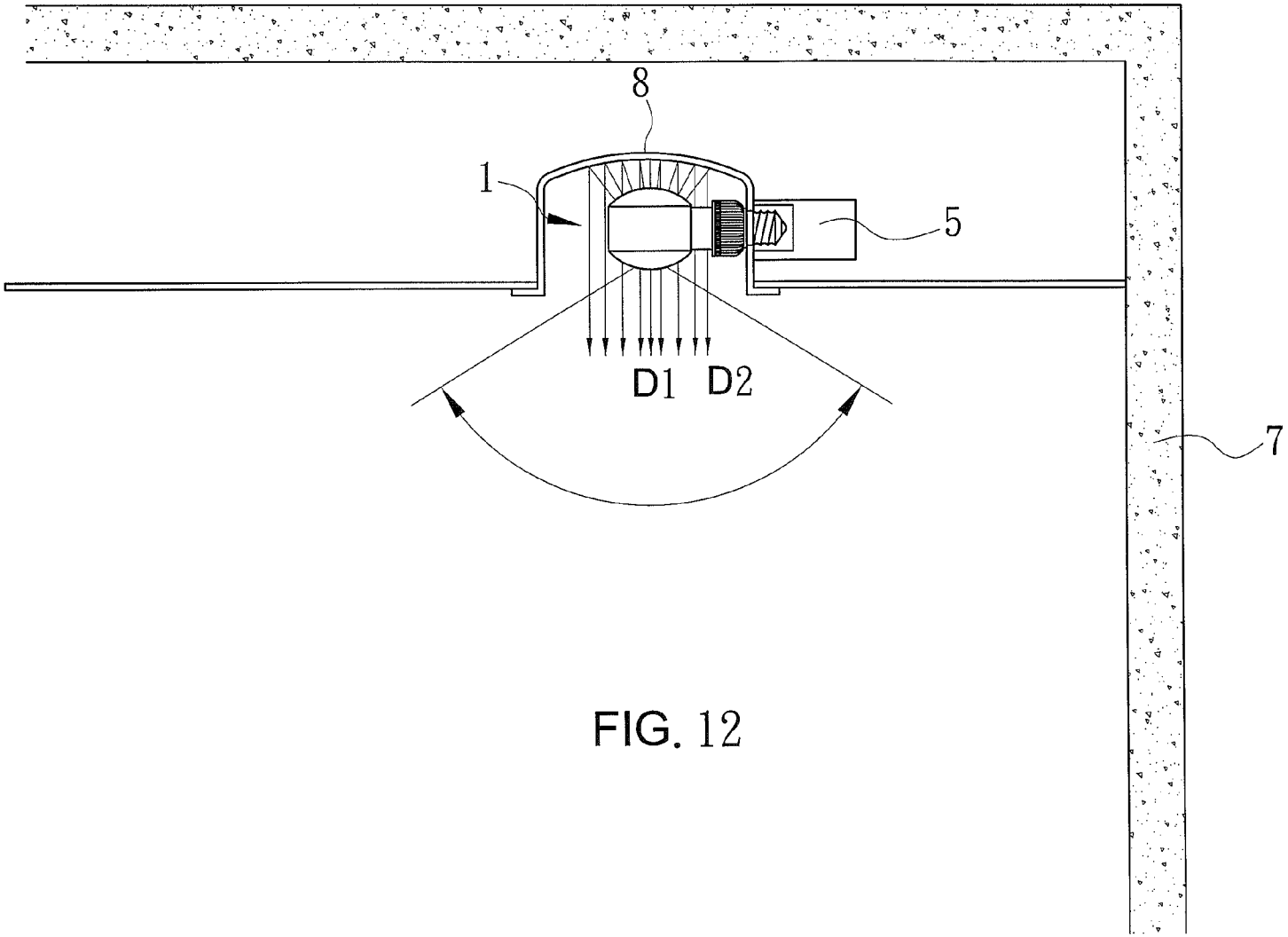
FIG. 12 is a schematic view illustrating the LED bulb of FIG. 11 which has been assembled into the horizontally arranged bulb socket.

FIG. 11 illustrates a LED bulb 1 of a third embodiment of the present invention. In the embodiment, the shell body 16 includes two opposed openings 161, and each opening 161 is assembled with a lampshade 18. A 90-degree projecting angle is formed between a direction of the light beams projected from each opening 161 on the shell body 16 and the axial direction (X) of the tubular column 163. The luminosity module 17 includes upper and lower substrates 171 and LEDs 172 on an outer surface of each of the upper and lower substrates 171. The upper and lower substrates 171 are installed on both flanks of the heat sink body 173. When the LED bulb 1 of this embodiment is installed in the horizontally arranged bulb socket 5 (see FIG. 12), downward projected beams (D1) out of the LEDs 172 on the lower substrate 171 are directly radiated via the lower opening 161 to the ground surface, and downward reflected beams (D2) out of a reflective bowl of a reflector holder 8 which collects light beams from the LEDs 172 on the upper substrate 171 are projected onto the ground surface for projection of stronger light beams.

Figure 14:
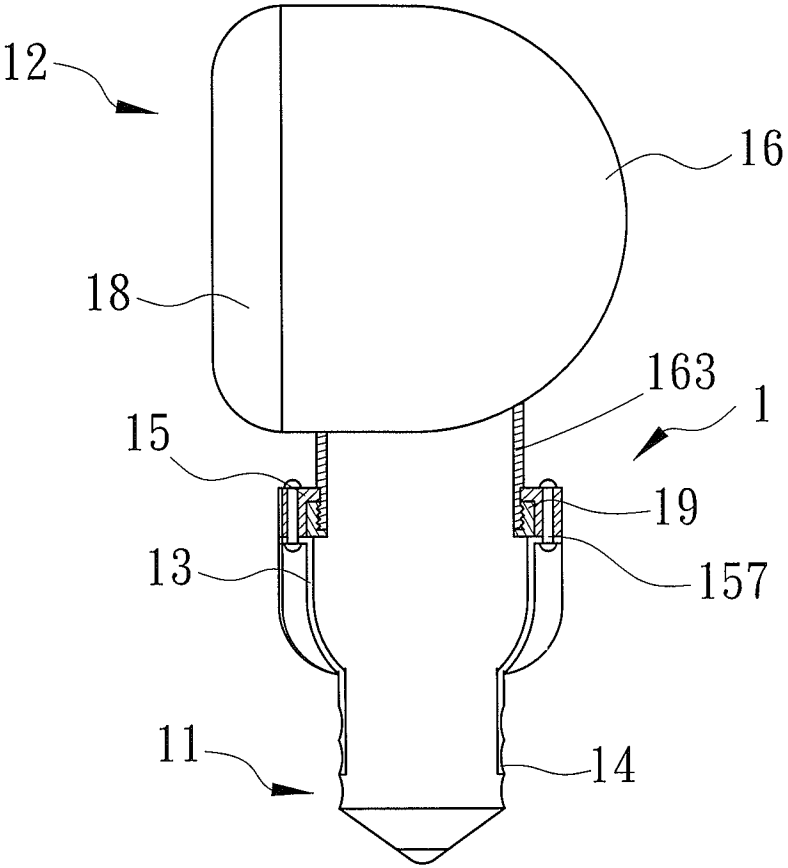
FIG. 14 is a schematic view of a LED bulb according to a fifth embodiment of the present invention.
Figure 13:
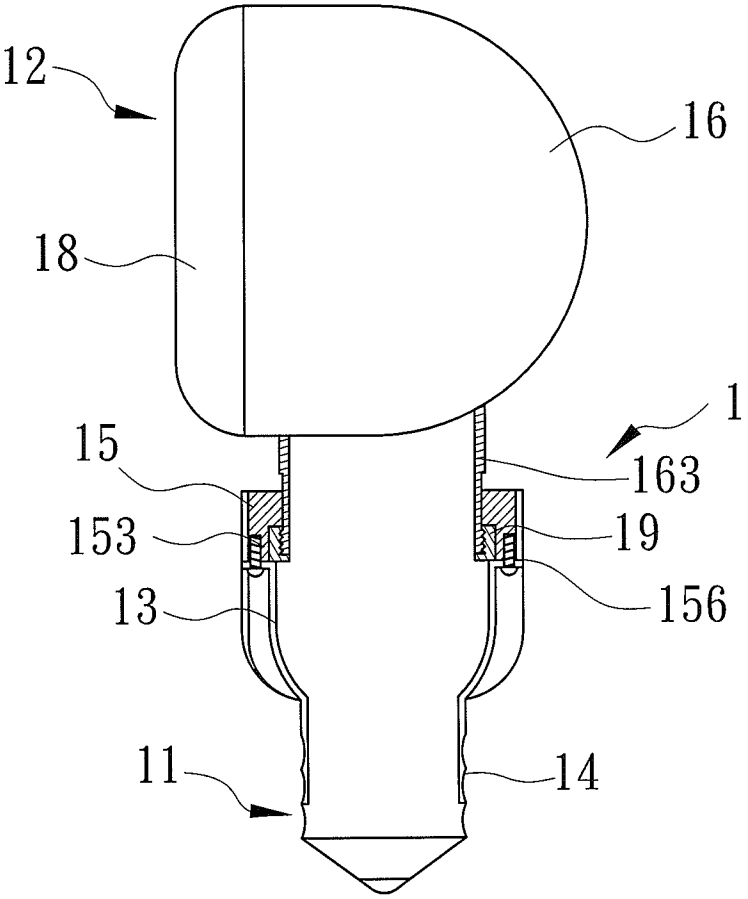
FIG. 13 is a schematic view of a LED bulb according to a fourth embodiment of the present invention.
Figure 15:
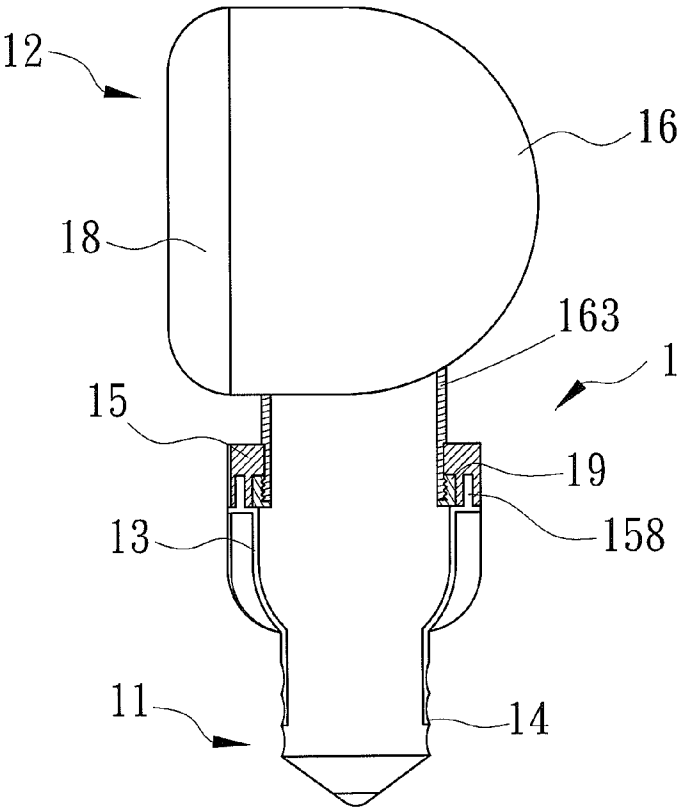
FIG. 15 is a schematic view of a LED bulb according to a sixth embodiment of the present invention.

In the present disclosure, a provision to join the collar 15 at the upper end of the bulb holder base 13 is not limited to threads (female threads 133 and male threads 155) in the first embodiment. FIG. 13 illustrates the joining portion 153 joins at the upper end of the bulb holder base 13 with screws 156. FIG. 14 illustrates the collar 15 joins at the upper end of the bulb holder base 13 with rivets 157. FIG. 15 illustrates the collar 15 joins with pins 158 and fuses at the upper end of the bulb holder base 13.

Figure 16:
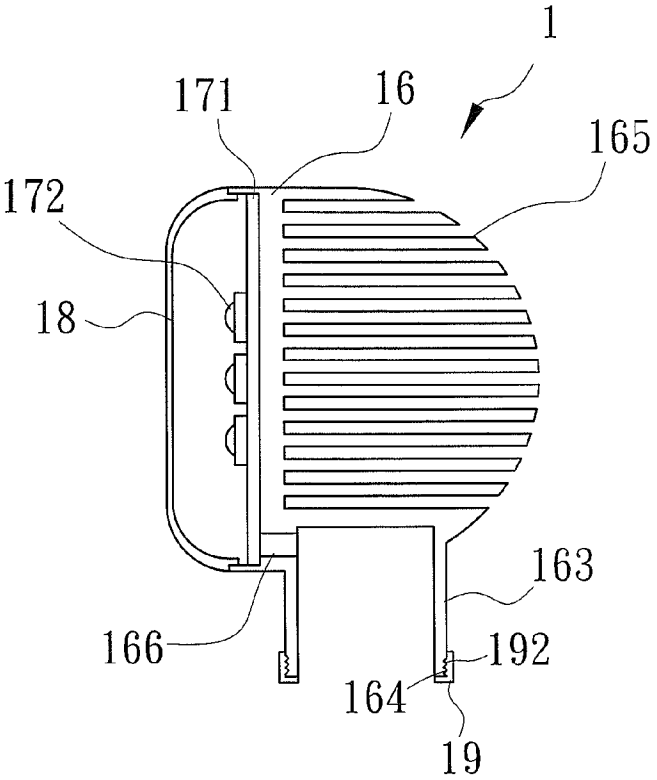
FIG. 16 is a schematic view of a LED bulb according to a seventh embodiment of the present invention.
Figure 18:
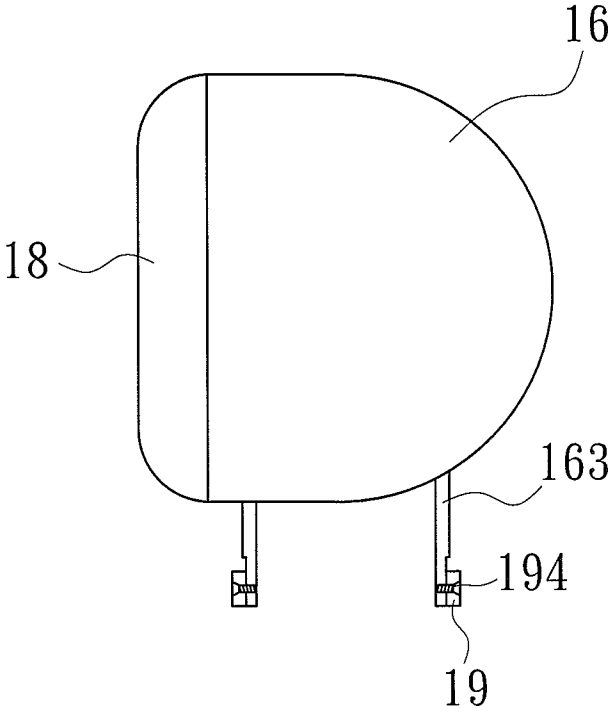
FIG. 18 is a schematic view of a LED bulb according to a ninth embodiment of the present invention.
Figure 17:
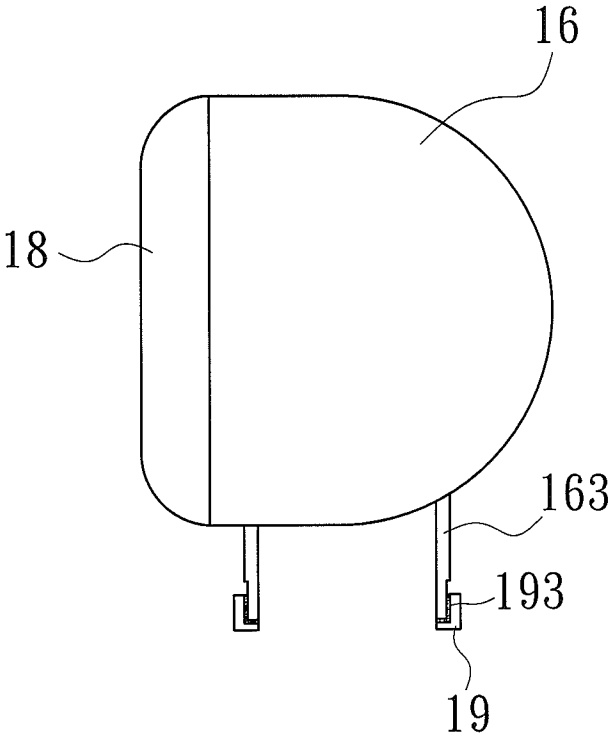
FIG. 17 is a schematic view of a LED bulb according to an eighth embodiment of the present invention.
Figure 19:
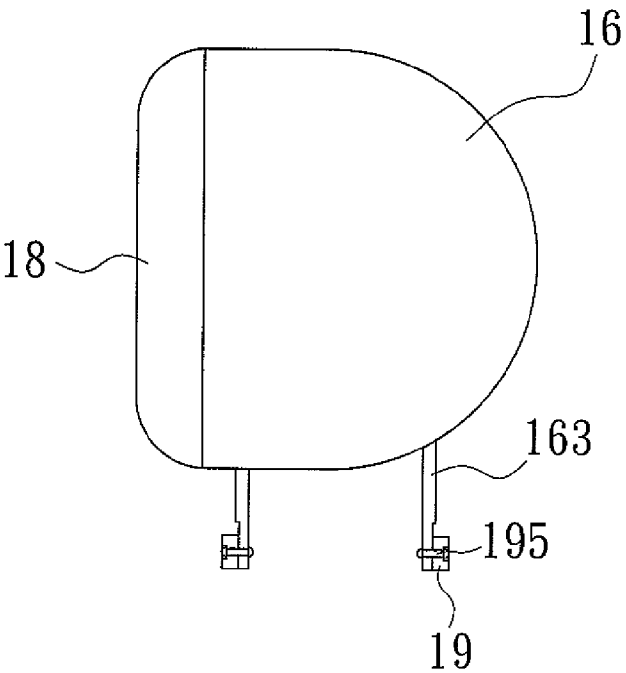
FIG. 19 is a schematic view of a LED bulb according to a tenth embodiment of the present invention.

FIG. 16 illustrates the clasper 19 of the LED bulb 1 of the present invention joined at the first end 164 of the tubular column 163 with threads, and the shell body 16 is provided with cooling fins 165. Furthermore, a provision to engage the clasper 19 with the tubular column 163 is not limited to threads in the first embodiment. FIG. 17 illustrates that the clasper 19 is engaged with the tubular column 163 by fusion 193. FIG. 18 illustrates that the clasper 19 is engaged with tubular column 163 by screws 194. FIG. 19 illustrates that the clasper 19 is engaged with the tubular column 163 by rivets 195.

Figure 20:
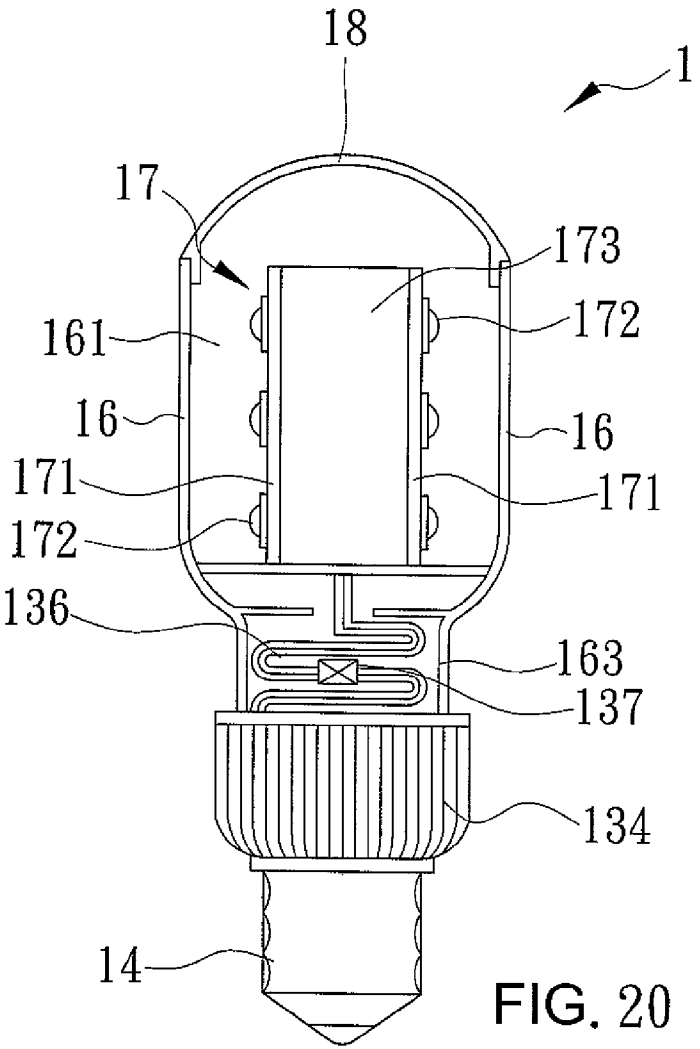
FIG. 20 is a schematic view of a LED bulb according to an eleventh embodiment of the present invention.
Figure 21A:
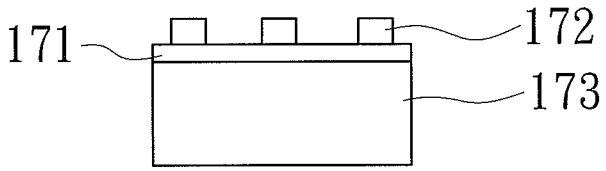
FIGS. 21*a* through 21*d* illustrate LEDs of the bulb of the present invention installed on one or a number of flanks of a heat sink body.
Figure 21B:
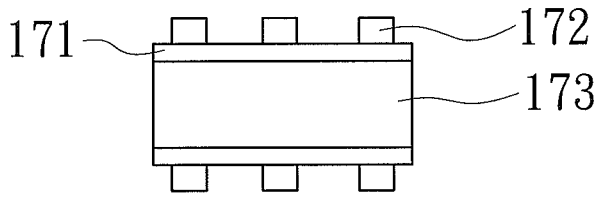
Figure 21C:
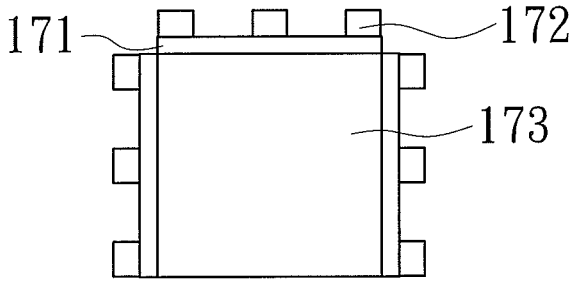
Figure 21D:
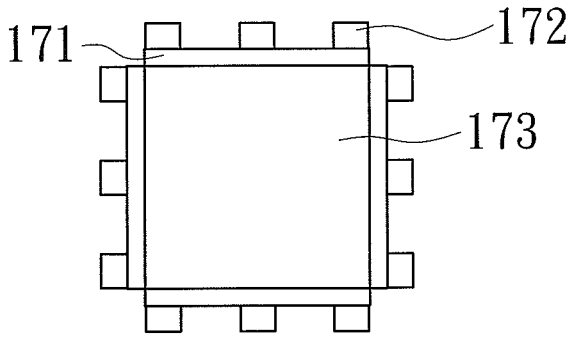
Figure 22:
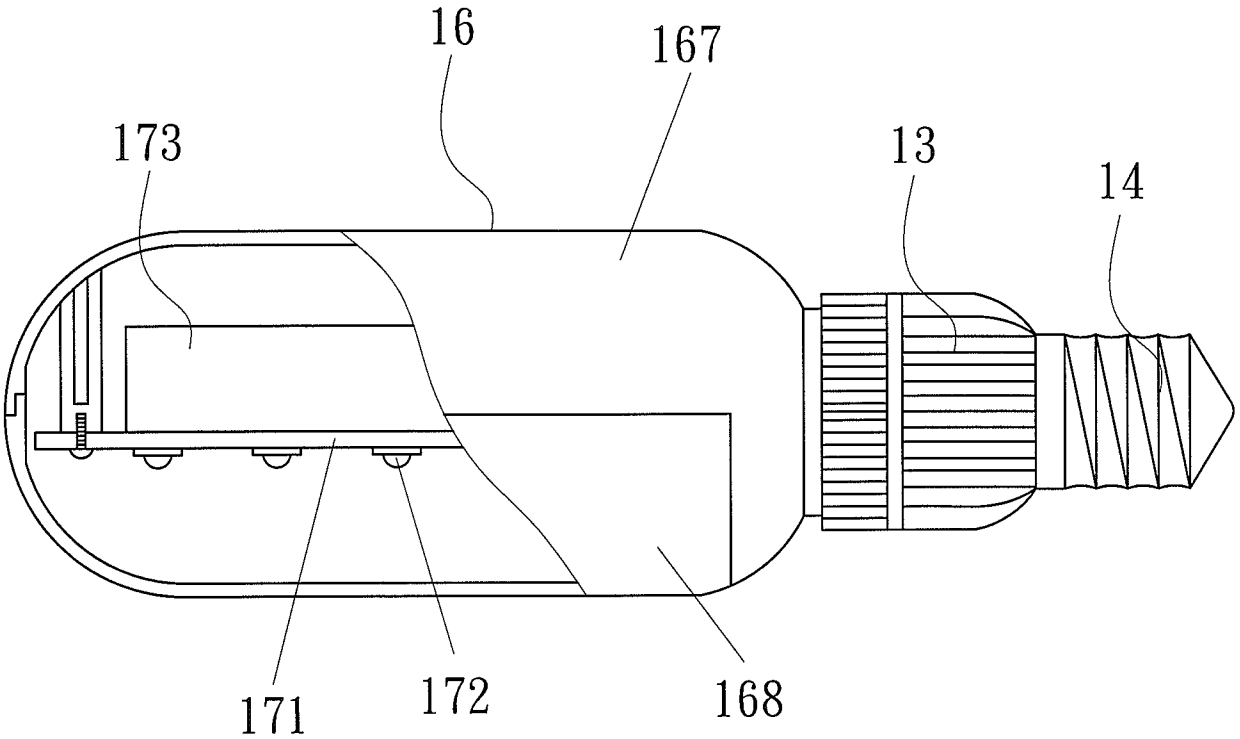
FIG. 22 is a schematic view of a LED bulb according to an twelfth embodiment of the present invention.

In the lamp carrier assembly 12, the shell body 16 of the LED bulb 1 can be designed as an alternative style, such as a transparent tubular body (FIG. 20), in addition to a semicircular shape. Moreover, the substrates 171 and the LEDs 172 can be mounted on a number of flanks of the heat sink body 173 in addition to a single flank (FIG. 21*a*) or two flanks (FIG. 21*b*) of the heat sink body 173. As shown in FIG. 21*c* and FIG. 21*d*, the substrates 171 and the LEDs 172 are mounted on three flanks and four flanks of the heat sink body 173. Furthermore, FIG. 22 illustrates the shell body 16 of the lamp carrier assembly 12 includes a semi-cylindrical base 167 and a semi-cylindrical bulb shell 168 covered on the semi-cylindrical base 167.

The present invention improves over the prior art. While the invention has been described by device of specific embodiments, numerous modifications and variations could be made thereto by those generally skilled in the art without departing from the scope and spirit of the invention set forth in the claims.

The invention claimed is:

1. A LED bulb laterally installed and projecting light beams onto ground comprising:

a bulb holder assembly including a bulb holder base and a bulb holder installed on a lower end of the bulb holder base, with a top opening formed in an upper end of the bulb holder base, with an actuator provided in the bulb holder base;

a lamp carrier assembly including a tubular column having a first end mounted in the top opening of the bulb holder base, with a shell body formed at a second end of the tubular column and having at least one opening for projection of light beams, with a 90-degree or 45-degree projecting angle formed between a direction of the projected light beams from the opening of the shell body and an axial direction of the tubular column;

a luminosity module installed inside the shell body and electrically connected to the actuator, with the luminosity module including at least one substrate and at least one LED on the at least one substrate;

a lampshade assembled on the opening of the shell body for transmission of the light beams out of the at least one LED;

an annular collar concentrically mounted around the first end of the tubular column and secured to the upper end of the bulb holder base, with the annular collar including an annular joining portion formed at a lower end thereof, with an annular accommodating space formed between the annular joining portion and the tubular column; and an annular clasper rotatably received in the annular accommodating space and securely connected to the first end of the tubular column, wherein the annular clasper in the annular accommodating space is intermediate the annular collar and the bulb holder base in the axial direction, with the annular clasper and the tubular column rotatable about the axial direction relative to the bulb holder base and the annular collar, and wherein the lamp carrier assembly is adjustable relative to the bulb holder base to make a projecting plane of the at least one LED face the ground.

2. The LED bulb as claimed in claim 1, wherein the annular collar joins at the bulb holder base with threads, screws, rivets, pins or by fusion connection.

3. The LED bulb as claimed in claim 1, wherein the annular clasper joins at the tubular column with threads, screws, rivets, pins or by fusion connection.

4. The LED bulb as claimed in claim 1, wherein a plurality of knurls is formed on each of an outer surface of the bulb holder base, an outer periphery of the shell body, and an outer surface of the annular collar and extends in the axial direction of the tubular column.

5. The LED bulb as claimed in claim 1, wherein the shell body includes two opposed openings, with a 90-degree projecting angle formed between a direction of the light beams projected from each opening of the shell body and the axial direction of the tubular column, wherein the at least one substrate includes upper and lower substrates and the at least one LED comprises LEDs on an outer surface of each of the upper and lower substrates, and wherein the upper and lower substrates are installed on both flanks of a heat sink body.

6. The LED bulb as claimed in claim 5, wherein a plurality of knurls is formed on each of an outer surface of the bulb holder base, an outer periphery of the shell body, and an outer surface of the annular collar and extends in the axial direction of the tubular column.

7. The LED bulb as claimed in claim 1, wherein the shell body is a semicircular body or a transparent tubular body.

8. The LED bulb as claimed in claim 1, wherein the shell body of the lamp carrier assembly includes a semi-cylindrical base and a semi-cylindrical bulb shell covered on the semi-cylindrical base.

* * * * *